US009821189B1

(12) United States Patent
Saar

(10) Patent No.: US 9,821,189 B1
(45) Date of Patent: Nov. 21, 2017

(54) FOOT HARNESS FOR LOWER BODY CABLE MACHINE EXERCISES

(71) Applicant: Robert Jeffrey Saar, Irvine, CA (US)

(72) Inventor: Robert Jeffrey Saar, Irvine, CA (US)

( * ) Notice: Subject to any disclaimer, the term of this patent is extended or adjusted under 35 U.S.C. 154(b) by 0 days.

(21) Appl. No.: 15/166,150

(22) Filed: May 26, 2016

Related U.S. Application Data

(60) Provisional application No. 62/167,534, filed on May 28, 2015.

(51) Int. Cl.
*A63B 21/02* (2006.01)
*A63B 21/00* (2006.01)

(52) U.S. Cl.
CPC ..... *A63B 21/4015* (2015.10)

(58) Field of Classification Search
CPC ..... A63B 23/08; A63B 23/10; A63B 21/4015; A63B 2023/006; A63B 2208/0204; A63B 21/02; A63B 21/4011; A63B 21/4034; A63B 21/4013; A63B 69/0059
USPC ..... 482/79; 602/27
See application file for complete search history.

(56) References Cited

U.S. PATENT DOCUMENTS 3,752,474 A * 8/1973 Macabet ..... A63B 21/154 482/131
5,020,525 A * 6/1991 Ewing ..... A61F 5/04 602/27
5,025,802 A * 6/1991 Laico ..... A61G 13/12 128/875
5,100,129 A * 3/1992 Porter ..... A63B 21/0552 482/125
5,558,609 A * 9/1996 Olschansky ..... A63B 21/0552 482/122
6,312,361 B1 * 11/2001 Hayes ..... A43B 3/20 36/106
6,390,957 B1 * 5/2002 Knight ..... A63B 23/08 482/121
7,261,679 B2 * 8/2007 Sload ..... A63B 21/0004 482/124
8,439,854 B2 * 5/2013 Terrio ..... A61H 1/0266 482/79
8,827,873 B2 * 9/2014 Arnstein ..... A61H 1/0266 482/79
8,845,568 B2 * 9/2014 Clark ..... A61F 5/04 602/32
9,017,235 B2 * 4/2015 Khademi ..... A63B 21/0557 482/121
9,259,605 B1 * 2/2016 Puig ..... A63B 7/00
2005/0043150 A1 * 2/2005 Nitta ..... A63B 21/026 482/79

(Continued)

OTHER PUBLICATIONS

Stroops All-Legs 3-Ring Ankle Strap. Accessed from Amazon.com on Apr. 14, 2017. Earliest sale date based on reviews: Dec. 9, 2010. https://www.amazon.com/Stroops-All-Legs-3-Ring-Ankle-Strap/dp/B003OV9B02/ref=sr_1_1?s=sporting-goods&ie=UTF8&qid=1492185657&sr=1-1&keywords=stroops+ankle+strap.*

(Continued)

*Primary Examiner* — Andrew S Lo

(57) ABSTRACT

A foot harness is disclosed for use with cable machines to provide improved range of motion for lower body exercises. The foot harness includes a sole strap and a heel strap. The heel strap includes forward ends that attach to a cable. The forward ends rise at an angle from the plane of the sole so that the point of resistance for the exercise is emphasized on the foot rather than on the attachment point.

5 Claims, 4 Drawing Sheets

(56) References Cited

U.S. PATENT DOCUMENTS

| | | | | |
|---|---|---|---|---|
| 2010/0041527 | A1* | 2/2010 | Miller | A63B 21/0552 482/124 |
| 2014/0171276 | A1* | 6/2014 | Strachan | A63B 21/0557 482/124 |
| 2014/0274612 | A1* | 9/2014 | Pesko | A63B 21/00163 482/139 |
| 2016/0101309 | A1* | 4/2016 | Schreiber | A61F 5/0127 482/124 |
| 2016/0256732 | A1* | 9/2016 | Kasner | A63B 21/4015 |
| 2016/0296787 | A1* | 10/2016 | Kamins | A63B 21/4013 |

OTHER PUBLICATIONS

Xtreme Glute Strap. Accessed from Amazon.com on Apr. 14, 2017. Earliest sale date based on reviews: Mar. 20, 2015. https://www.amazon.com/XTREME-Glute-Strap-ADJUSTABLE-RESULTS-GUARANTEED/dp/B00R5OSZ42/ref=cm_cr_arp_d_product_top?ie=UTF8.*

* cited by examiner

FOOT HARNESS FOR LOWER BODY CABLE MACHINE EXERCISES

CROSS-REFERENCE TO RELATED APPLICATIONS

This application claims benefit under 35 U.S.C. §119(e) of U.S. Provisional Application having Ser. No. 62/167,534 filed May 28, 2015, which is hereby incorporated by reference herein in its entirety.

BACKGROUND

The embodiments herein relate generally to fitness equipment, and more particularly, to a foot harness for lower body cable machine exercises.

When training the posterior chain of the human body, mobility optimization, as well as neuro efficiency is very critical. Current devices don't properly encapsulate and stabilize the foot, other devices will ride up the user's leg. Some foot harnesses attach from a ring at the front of the ankle or directly from the top of the foot. In other cases straps will extend off the foot harness at a perpendicular angle, causing an un-natural pull on the users foot. Thus, such devices do not correctly engage the necessary proprioception of the human nervous system. The point of resistance is un-naturally placed on the foot or lower leg and maximum targeting of the lower body is not realized during cable based exercises.

As can be seen, there is a need for a foot harness that provides the user optimized use of foot strength during cable based exercises. In conjunction with optimized force vectors in relation to the harness resistance attachment point length, and angle.

SUMMARY

According to one embodiment, a foot harness for wearing on a shoe during cable based exercises comprises a first strap configured to loop around a sole of the shoe and over an upper of the shoe. A second strap is attached to the first strap. The second strap includes a rear portion configured to loop around a heel section of the shoe and a front portion. The front portion includes strap ends projecting forward from the heel. The rear portion is attached to the first strap at an intersection. The intersection defines a point from which the front portion is attached or assembled at an angle upward from the rear portion so that the strap ends naturally rise at an angle from the rear portion.

BRIEF DESCRIPTION OF THE FIGURES

The detailed description of some embodiments of the present invention is made below with reference to the accompanying figures, wherein like numerals represent corresponding parts of the figures.

DETAILED DESCRIPTION OF CERTAIN EMBODIMENTS

The word "exemplary" is used herein to mean "serving as an example or illustration." Any aspect or design described herein as "exemplary" is not necessarily to be construed as preferred or advantageous over other aspects or designs.

Figure 1:
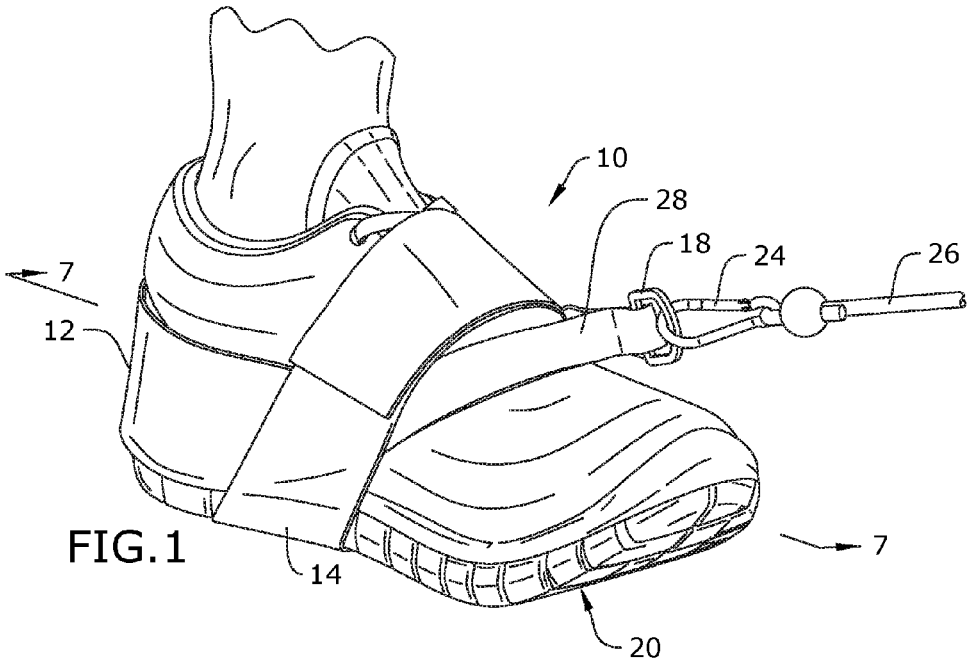
FIG. 1 is a front perspective view of a foot harness in use with the foot planar to the floor in accordance with an exemplary embodiment of the subject technology.
Figure 2:
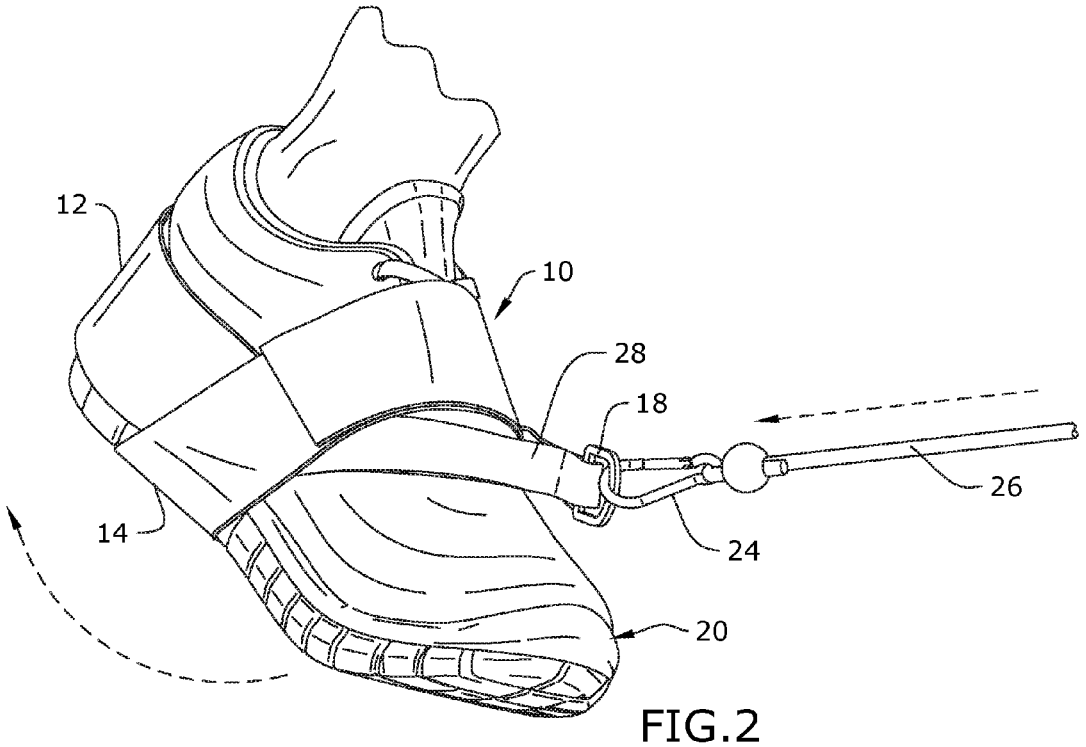
FIG. 2 is a front perspective view of the foot harness of FIG. 1 in use with a heel of the foot flexed upward from the floor during a kickback motion.
Figure 3:
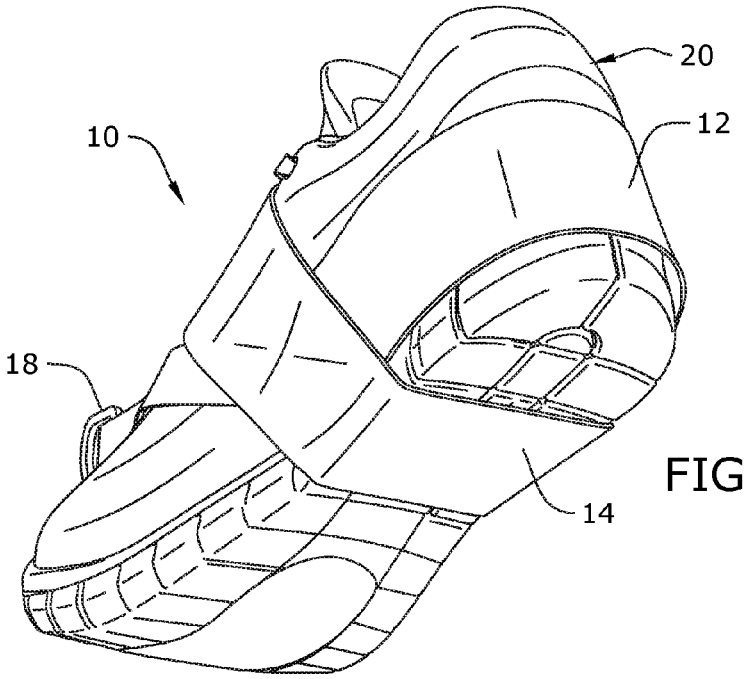
FIG. 3 is a rear perspective view of the foot harness of FIG. 2 in use.
Figure 4:
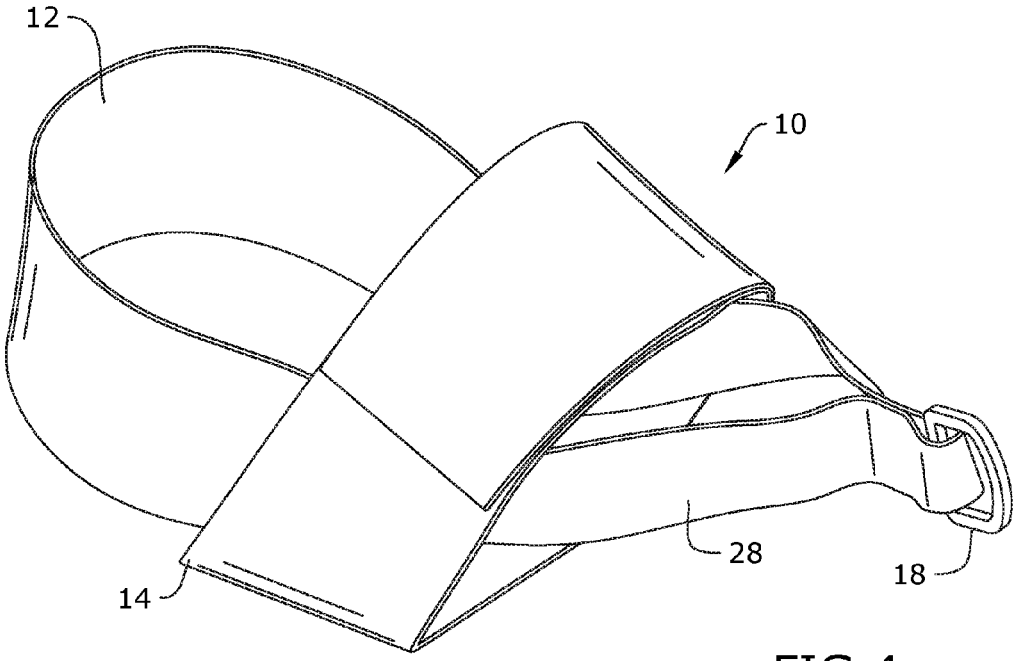
FIG. 4 is a front, side perspective view of the foot harness of FIG. 1.
Figure 5:
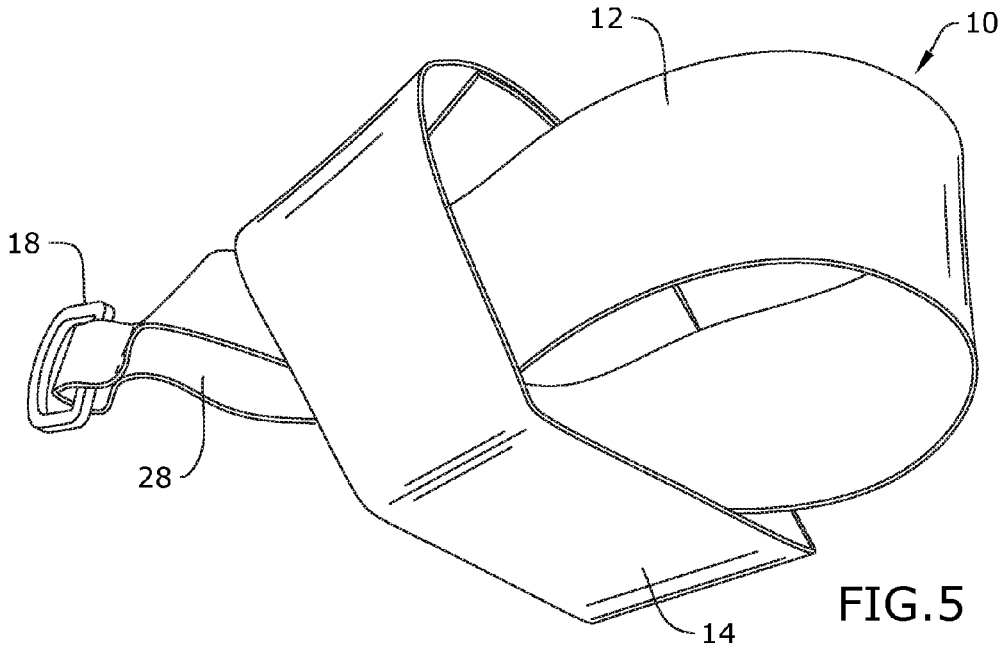
FIG. 5 is a rear, side perspective view of the foot harness of FIG. 4.
Figure 6:
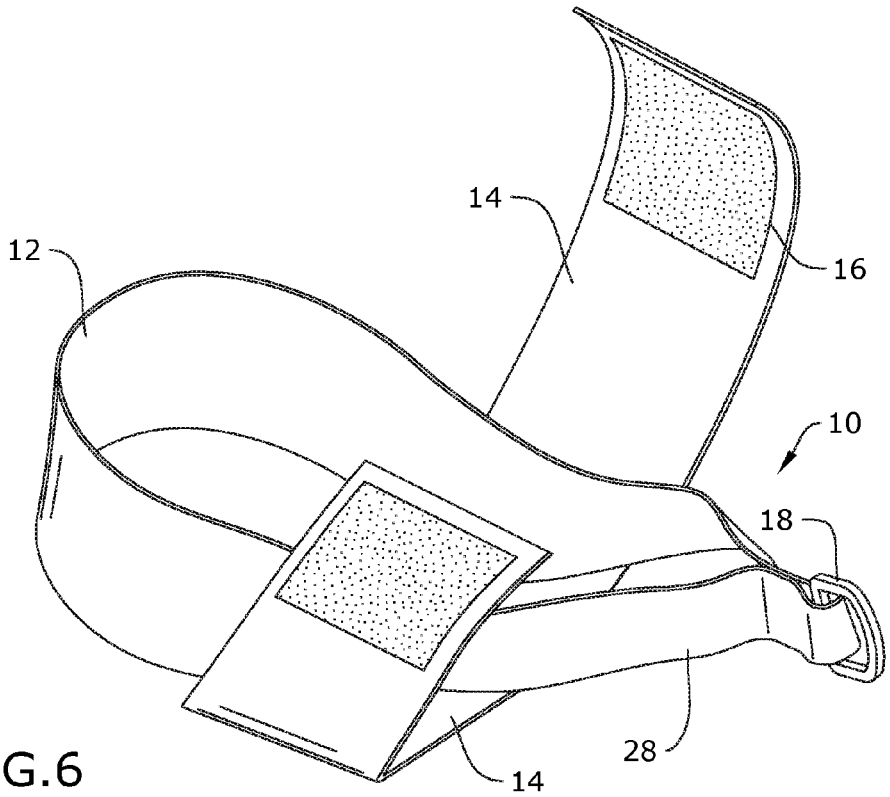
FIG. 6 is a front, side perspective view of the foot harness of FIG. 4 with a sole strap in an open position.
Figure 7:
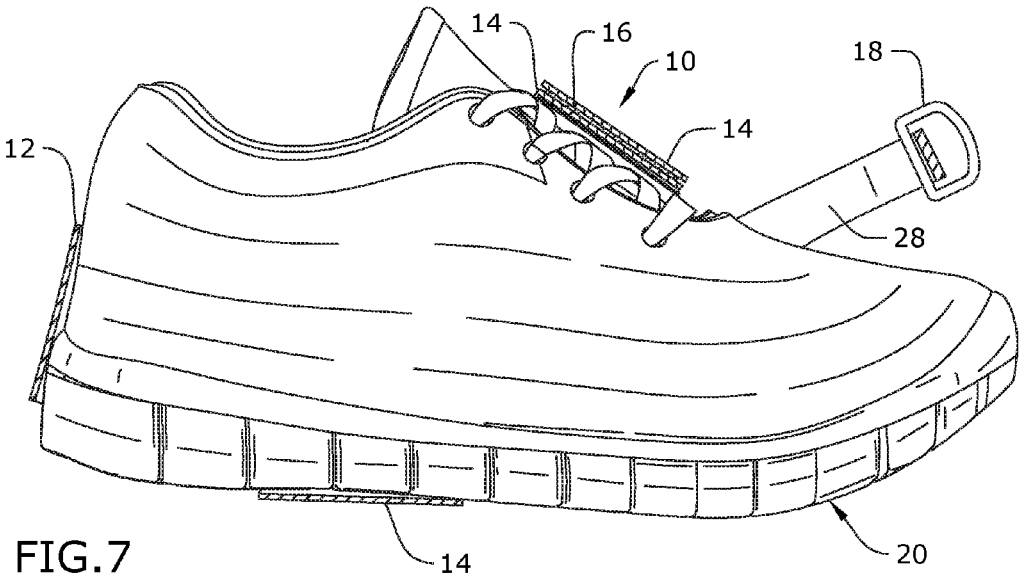
FIG. 7 is a cross-sectional view taken along the line 7-7 of FIG. 1.

By way of example, and referring to FIGS. 1-7, an embodiment of the subject technology comprises a foot harness 10. As will be appreciated, aspects of the foot harness 10 focus the point of resistance for resistance based exercises to the foot, through an angular strap based attachment point, unlike prior art harnesses which place the point of resistance directly on or extended away from the users foot through perpendicular straps. The foot harness 10 includes a heel strap 12 and a sole strap 14. The straps 12 and 14 may be fabric based. In an exemplary embodiment, the heel strap 12 includes a rear portion looping around the heel of a shoe 20 and a front portion comprising strap ends 28 projecting forward of the heel section and up at an angle from a plane of the sole of the shoe. In some embodiments, the front portion and the rear portion may be two pieces attached together or may be one piece with the front portion attached to the sole strap 14 to rise at an angle. In some embodiments, a high friction lining may line an interior surface of the heel strap 12 to aid the user in maintaining a proper position and traction of the heel within the harness 10 during operation. The straps ends 28 rise up from an intersection where the heel strap 12 attaches to the sole strap 14. In an exemplary embodiment, when the harness 10 is worn over the shoe 20, the strap ends 28 are attached or assembled at an angle to elevate above the shoe's vamp section as a fastener 18 (for example, a D-ring) is attached to a carabiner 24 of a cable 26 attached to a cable exercise machine (not shown).

The sole strap 14 may be configured to loop around the sole of the shoe 20 and over the shoe's upper. In some embodiments, the sole strap 14 may include a bottom section flattened for positioning under the shoe's sole so that the harness 10 makes planar contact with the sole when used. The sole strap 14 may be open ended above the upper and may include a hook and loop fastener system 16 to secure the sole strap 14 to the shoe 20.

As will be appreciated, the foot harness 10 directs full possible neuro energy to the involved major muscle groups, through proper stabilization optimal mobility and decreased pain perception of the human foot. The angle of the strap ends 28 attached or assembled at an angle, moves the point of attachment up and away from the foot so that a natural full range of possible motion can be realized. When connected to the cable 26, the point of resistance is moved down into the sole of the shoe 20 where the foot may push against the sole strap 14 and heel strap 12 rather than pull at the ankle or compress the users foot at or near the point of attachment. The harness 10 may be especially useful for movements to train and isolate the lower posterior (back of the body) musculature of the human body including for example, the gluteus and hamstring muscles. The mid-foot mounted lower sole strap 14 locates the heel strap 12 to correct vertical placement of the user's foot. The mid-foot positioned strap ends 28 on the top of the foot urge the user's foot to remain seated against heel strap 12. Indirect work will be associated with the low back and associated torso extensors. In addition, the foot harness 10 may also allow users to safely and efficiently perform leg adduction movements, as well as leg abduction movements as the mid-foot positioned and angled strap ends 28 expose the users foot and leg to natural feeling rotational forces during lateral lower body work. This resulting foot rotation provides an improved stability at the users ankle, knee, and associated joints in relation to the ankle and knee. This is due to the rotational forces stimulating beneficial proprioception of the associated calf musculature, which then provides the user improved leg, and associated leg joint support.

Persons of ordinary skill in the art may appreciate that numerous design configurations may be possible to enjoy the functional benefits of the inventive systems. Thus, given the wide variety of configurations and arrangements of embodiments of the present invention the scope of the present invention is reflected by the breadth of the claims below rather than narrowed by the embodiments described above.

What is claimed is:

1. A foot harness for wearing on a shoe during resistance based exercises, comprising:

a first strap configured to loop around a sole of the shoe; and a second strap attached to the first strap and including a rear portion configured to loop around a heel section of the shoe and a front portion including strap ends projecting forward from the heel section, wherein the rear portion is attached to the first strap at an intersection, and wherein the intersection defines a point from which the front portion is attached or assembled at an angle upward from the first strap and the rear portion so that the strap ends rise by design at an angle from the first strap and rear portion so that the front portion projects forward of the heel section and up at an angle from a plane of the sole of the shoe.

2. The foot harness of claim 1, wherein the first strap includes a bottom section including creases defining a flat section positioned under the sole of the shoe.

3. The foot harness of claim 1, wherein the first strap includes a hook and loop fastener system for securing the foot harness over an upper portion of the shoe.

4. The foot harness of claim 1, further comprising a high friction lining positioned on an interior surface of the second strap.

5. The foot harness of claim 1, further comprising a fastener coupling the strap ends together for attaching to a cable, wherein the front portion is elevated by design above a shoe vamp when the harness is attached to the cable.

* * * * *